US007086641B2

(12) United States Patent
Petrozziello

(10) Patent No.: US 7,086,641 B2
(45) Date of Patent: Aug. 8, 2006

(54) PROTECTIVE GUARD FOR A FENCE

(75) Inventor: Louis J. Petrozziello, Short Hills, NJ (US)

(73) Assignee: Remington Enterprises, Inc., Edison, NJ (US)

( * ) Notice: Subject to any disclaimer, the term of this patent is extended or adjusted under 35 U.S.C. 154(b) by 268 days.

(21) Appl. No.: 10/199,803

(22) Filed: Jul. 19, 2002

(65) Prior Publication Data

US 2004/0012006 A1 Jan. 22, 2004

(51) Int. Cl.
*E04H 17/00* (2006.01)

(52) U.S. Cl. ..... 256/1; 256/32

(58) Field of Classification Search ..... 256/1, 256/11, 12, 19, 21, 24, 32, 47, 59, 65.01, 256/65.02, 65.03, 65.04, 66
See application file for complete search history.

(56) References Cited

U.S. PATENT DOCUMENTS

| | | | | |
|---|---|---|---|---|
| 399,617 | A | 3/1889 | Ihnen | |
| 1,636,189 | A * | 7/1927 | Louden | 256/24 |
| 3,395,489 | A * | 8/1968 | Banse | 256/24 X |
| 3,622,125 | A * | 11/1971 | Powell | |
| 3,648,981 | A * | 3/1972 | Allen | 256/24 |
| 3,707,276 | A * | 12/1972 | Francis et al. | 256/24 X |
| 3,933,311 | A * | 1/1976 | Lemelson | 256/19 X |
| 3,960,367 | A * | 6/1976 | Rogers | 256/21 |
| 4,022,452 | A | 5/1977 | Dupre | |
| 4,071,223 | A * | 1/1978 | Demarest | 256/1 |
| 4,349,989 | A | 9/1982 | Snider, Jr. | |
| 4,497,472 | A * | 2/1985 | Johnson | 256/32 |
| 4,508,320 | A * | 4/1985 | Hegarty | 256/47 |
| 4,548,388 | A | 10/1985 | Cobler | |

(Continued)

FOREIGN PATENT DOCUMENTS

GB 2273524 A * 6/1994

*Primary Examiner*—Daniel P. Stodola
(74) *Attorney, Agent, or Firm*—Lerner, David, Littenberg, Krumholz & Mentlik, LLP

(57) ABSTRACT

A protective guard securable over a top support bar of a fence includes an elongated member, such as an elongated tube, having first and second ends, an outer surface, an inner surface defining an interior space for capturing the top support bar and an elongated opening extending between the inner and outer surfaces and the first and second ends of the elongated member, whereby the elongated tubular member is securable over the top support bar of the fence. First and second attachment flanges are integrally formed with the elongated tube on opposite sides of the elongated opening, the first and second attachment flanges being adapted for engaging opposite sides of the fence when the protective guard is secured atop the top support bar of the fence. The protective guard may also include at least one securing element in contact with the first and second attachment flanges for securing the attachment flanges together on opposite sides of the fence.

18 Claims, 7 Drawing Sheets

U.S. PATENT DOCUMENTS 4,702,034 A 10/1987 Ferguson et al.
4,723,758 A 2/1988 Gehrig
4,789,138 A 12/1988 Acton
4,899,991 A * 2/1990 Brunkan ..... 256/24 X
4,907,783 A 3/1990 Fisk et al.
5,178,369 A * 1/1993 Syx ..... 256/32
5,328,156 A 7/1994 Hoke
5,340,086 A 8/1994 Dorr
5,402,988 A * 4/1995 Eisele ..... 256/24
5,597,262 A 1/1997 Beavers et al.
5,762,444 A * 6/1998 Giannelli
5,794,390 A 8/1998 Oliveri et al.
5,829,913 A 11/1998 Puckett
2001/0035523 A1* 11/2001 Venegas ..... 256/65 X
2001/0052595 A1* 12/2001 Hulett ..... 256/11

* cited by examiner 54
52
60
56
58

62

38
52
58
62
40

52
20

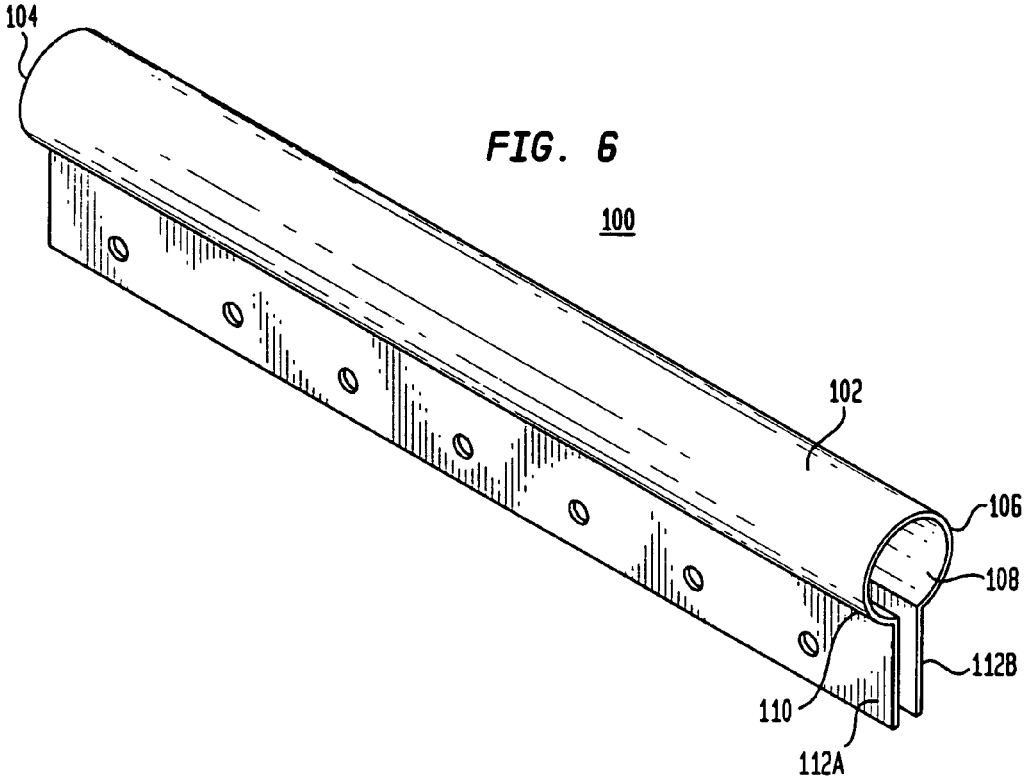
FIG. 6
FIG. 7
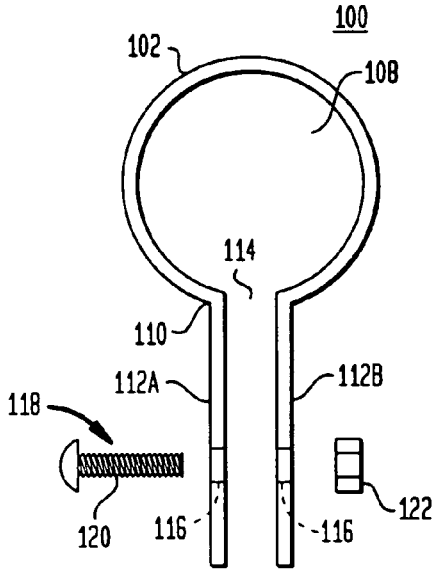
FIG. 8
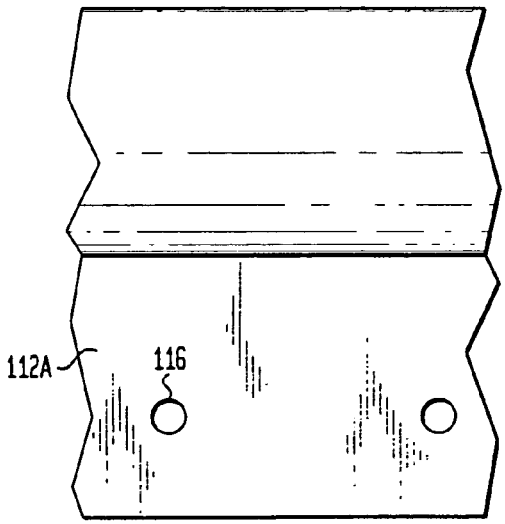

200

300

400

PROTECTIVE GUARD FOR A FENCE

BACKGROUND OF THE INVENTION

The present invention is generally related to fencing and is particularly related to protective guards securable to fences.

FIG. 1 shows a prior art chain link fence 20 secured to the ground 22. The chain link fence 20 includes an end post 24 having a lower end 26 secured in the ground 22 and an upper end 28 having a cap 30 secured thereto. The chain link fence 20 also includes one or more intermediate posts 32 having a lower end 34 secured to the ground and an upper end 36 remote therefrom. A top post 38 extends horizontally between end post 24 and the one or more intermediate posts 32. The chain link fence 20 includes a wire mesh 40 that is secured to top support bar 38 by wire loops 42. Wire mesh 40 is secured at its ends to reinforcement bar 44 which, in turn, is secured to end post 24 by clamp members 46 and 48.

The wire mesh 40 typically has relatively sharp or jagged edges 50 extending along an upper edge thereof. The upper portion of the chain link fence 20 also includes top support bar 38, upper ends 28 of end post 24, upper end 36 of intermediate post 32, cap 29 atop intermediate post 32, and a cap 30 atop end post 24. All of these items may cause injury to an individual as a result of a collision between the individual and the fence 20. As a result, there is a need for provide a protective guard that may be placed atop the upper edge of the chain link fence 20.

Referring to FIG. 2, one solution to this problem is provided by the prior art protective guard 52 shown in FIGS. 2–5. The protective guard 52 is an extruded, plastic tube having a first end 54, a second end 56 and a longitudinal axis extending therebetween. The protective guard 52 is essentially a flexible, elongated tube that defines an interior space 58. Referring to FIGS. 2 and 3, the elongated tube 52 is prepared for use as a protective guard atop a fence by making an elongated cut 60 extending between the first and second ends 54, 56 of the protective guard 52. As noted above, the elongated tube 52 is flexible so that the tube may be flexed apart at the cut line 60 to provide an opening 62 so that the tube may be placed atop the fence. The flexible tube also enables the tube to follow the contour of the fence.

Referring to FIG. 4, the protective guard 52 is placed atop fence 20 including top support rail 38 by inserting top support rail 38 through opening 62 and into interior space 58 of tube 52. The top support bar 38 is inserted until it abuts against an interior top surface of tube 52. FIG. 5 shows a perspective view of a chain link fence with elongated protective guard 52 secured atop an upper edge of the fence. One problem with this design is that the protective guard is not secured to the upper edge of the chain link fence 20. As a result, the protective guard 22 may become detached from the fence, thereby exposing an individual to the jagged or sharp features at the upper edge of the fence. In addition, the prior art protective guard shown in FIGS. 2–5 may be easily removed by a thief or vandal.

In view of the above problems, it is clear that there is a need for a protective guard that may be easily and reliably secured to an upper edge of a fence, such as a chain link fence. Moreover, there is a need for a protective guard for a fence that is not easily stolen or vandalized. There is also a need for a protective guard that may be easily detached from a fence for storage, such as winter storage.

SUMMARY OF THE INVENTION

In certain preferred embodiments, a protective guard securable over an upper edge of a fence includes an elongated member having first and second ends, an outer surface, an inner surface defining an interior space and an elongated opening extending between the inner and outer surfaces and the first and second ends thereof. In certain preferred embodiments, the elongated member is an elongated tube that is substantially cylindrical in shape and is adapted for fitting over the components that are typically present at the top of a fence, i.e., fence post, fence post cap, top support bar, wire mesh, slats, etc. The protective guard also preferably includes first and second attachment flanges integrally formed with the elongated member on opposite sides of the elongated opening, the first and second attachment flanges being adapted for engaging opposite sides of the fence when the protective guard is secured atop the fence. The protective guard also preferably includes one securing element in contact with the opposing first and second attachment flanges for securing the attachment flanges together on opposite sides of the fence. The at least one securing element preferably passes through the fence.

In certain preferred embodiments, the at least one securing element includes a plurality of securing elements and the first and second attachment flanges include a series of first and second openings, respectively, that are in substantial alignment with one another. To secure the protective guard to the fence, the plurality of securing elements are desirably passed through the first and second opening of the first and second attachment flanges.

In one particular preferred embodiment, the securing elements are passed through first openings in the first attachment flange, through a portion of the fence, and then through the second openings of the second attachment flange. As a result, the fence is sandwiched or clamped between the opposing first and second attachment flanges. The plurality of securing elements prevent the guard from being removed from its attachment to the fence.

In certain preferred embodiments, the attachment flanges are adapted for flexing away from one another so that the upper edge of the fence is passable between the first and second attachment flanges, through the elongated opening of the elongated member and into the interior space of the elongated member for positioning the protective guard over the upper edge of the fence. In certain embodiments, the fence is preferably a chain link fence including a top support bar and wire mesh secured to the top support bar. When the protective guard is secured over the chain link fence, the first and second attachment flanges are secured over opposite sides of the wire mesh. In other preferred embodiments, the fence is made of wood, such as wooden slats having upper ends whereby the protective guard is secured over at least one of the wooden slats. The elongated member may be designed to fit snuggly over the top of the fence.

The protective guard is preferably flexible so that it may conform to the shape of an upper edge of a fence. For example, the fence may be an outfield fence of a baseball field having a curved contour, and the protective guard is able to flex so as to curve and follow the contour of the outfield fence. The first and second attachment flanges integrally formed to the elongated member are also preferably flexible for conforming to the contour of the fence. In certain preferred embodiments, the elongated member and first and second attachment flanges integrally connected therewith are made of plastic. In other preferred embodiments, the elongated member and first and second attachment flanges integrally connected therewith are made of extruded plastic. The protective guard may be made of colored plastic. In certain preferred embodiments, the protective guard may be made of multiple colors that alternate. For example, the protective guard may alternate between a white plastic color and a blue plastic color. The colors may be repeatedly alternated along the length thereof to give the protective guard a striped appearance. The protective guard may also have horizontal stripes molded therein or text printed thereon.

During installation atop a fence, the opposing attachment flanges are preferably flexed away from one another so that an upper edge of the fence may pass between the opposing attachment flanges, past the elongated opening in the elongated member, and abut against the inner surface of the elongated member. The one or more securing elements may then engage the first and second attachment flanges and pass through a portion of the fence for reliably securing the protective guard to the upper edge of the fence. Although the present invention is not limited by any particular theory of operation, it is believed that providing opposing attachment flanges integrally connected with the protective guard makes for a more reliable attachment between the protective guard and the fence. The use of attachment flanges and securing elements passing through the attachment flanges prevents the protective guard from being jarred loose, blown away, or stolen by vandals. As a result, greater assurances exist that the protective guard will be in place when needed.

In one preferred embodiment, the protective guard is secured over the top of an outfield fence on a baseball field. Typically, such fences are made of wood or are chain link fences. The upper edges of such fences may be jagged, sharp or rough and may result in serious injury when a baseball player pursues a ball in the area of the fence. In numerous instances, baseball players have collided with the fence, particularly the upper edge of the fence, causing broken bones, broken teeth, concussions, etc. Providing a protective guard, including a elongated member over an upper edge of a baseball outfield fence, will soften any collision between a player and the fence, thereby minimizing injuries.

In still other preferred embodiments of the present invention, a protective guard securable over an upper edge of a fence includes an elongated, flexible member having first and second ends, an outer surface, an inner surface defining an interior space and an elongated opening extending between said inner and outer surfaces and said first and second ends. The protective guard also desirably includes first and second attachment flanges integrally formed with said elongated tube on opposite sides of said elongated opening, wherein said first and second attachment flanges are adapted for engaging opposite sides of said fence when said protective guard is secured atop said fence. The protective guard also desirably includes at least one securing element engaging said first and second attachment flanges and passing through said fence for securing said protective guard to said fence.

These and other preferred embodiments of the present invention will be discussed in more detail below.

BRIEF DESCRIPTION OF THE DRAWINGS

FIG. 6 shows a perspective view of a protective guard securable atop a fence, in accordance with certain preferred embodiments of the present invention.

FIG. 7 shows a cross-sectional view of the protective guard of FIG. 6 including a securing element for securing the protective guard to a fence.

FIG. 8 shows a fragmentary view of the protective guard shown in FIGS. 6 and 7.

DETAILED DESCRIPTION

Figure 1:
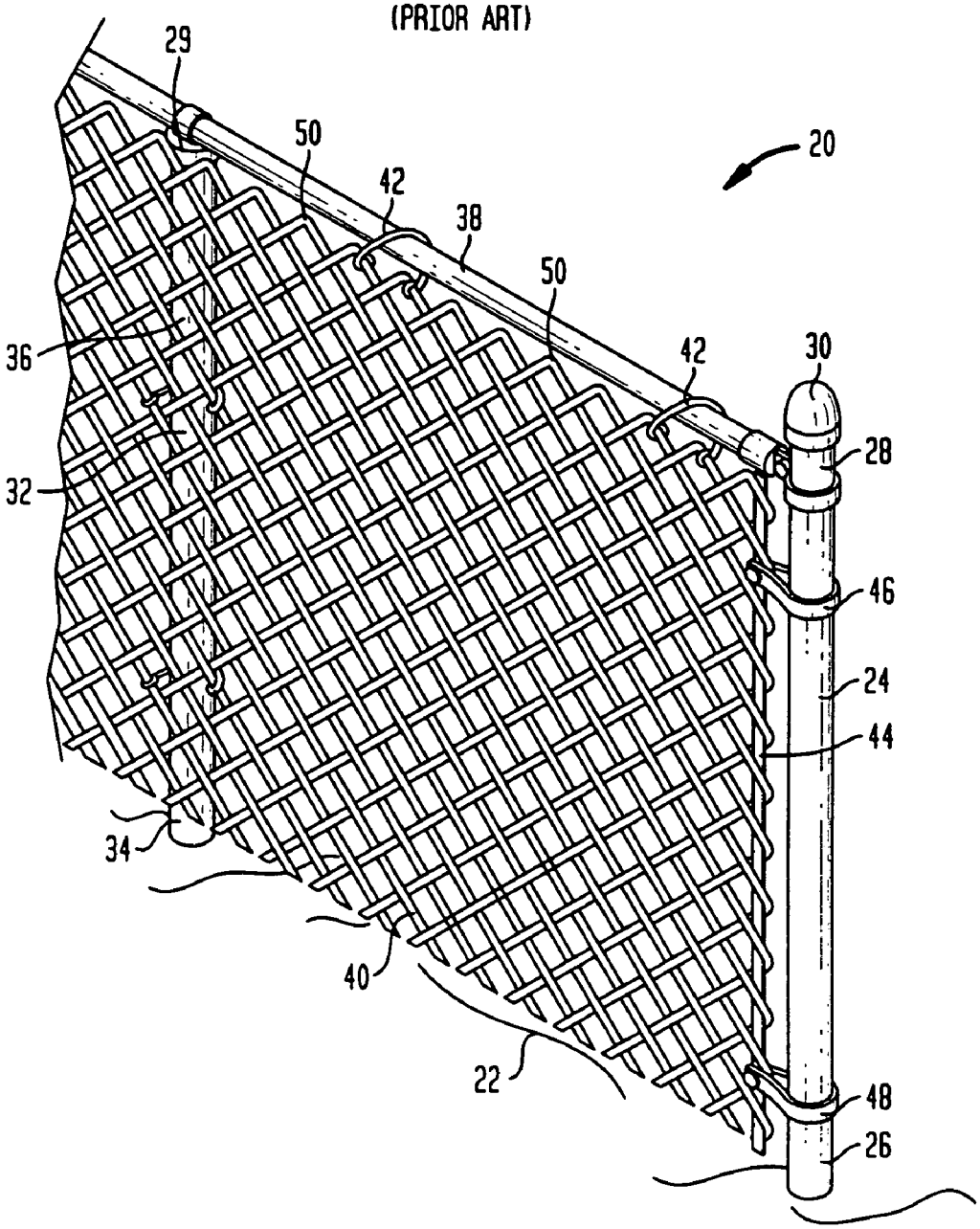
FIG. 1 (PRIOR ART)
FIG. 1 shows a perspective view of a prior art fence.
Figures 2, 3, 4, 5:
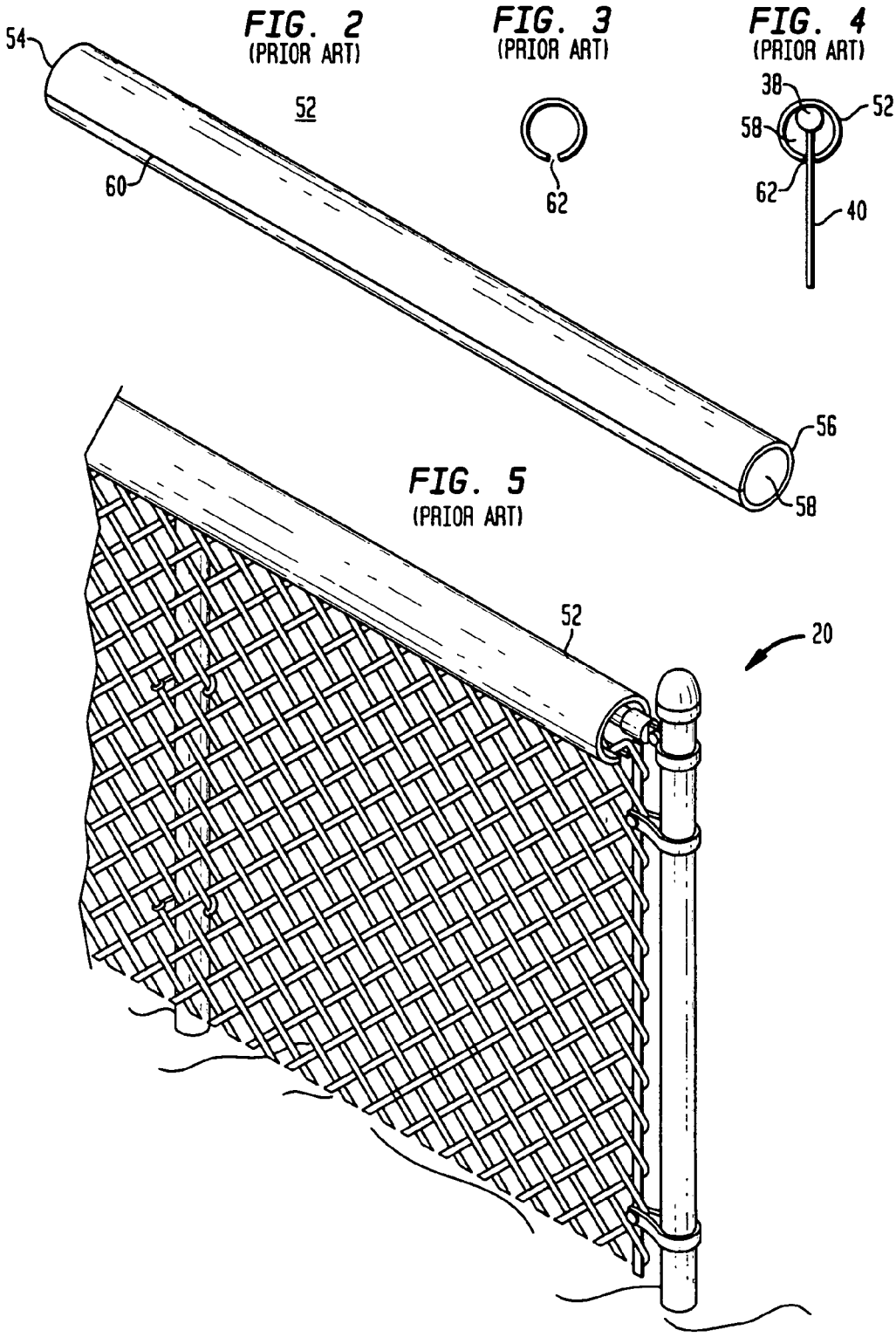
FIG. 2 (PRIOR ART)
FIG. 3 (PRIOR ART)
FIG. 4 (PRIOR ART)
FIG. 5 (PRIOR ART)
FIG. 2 shows a bottom view of a conventional protective guard for the fence of FIG. 1.
FIG. 3 shows a cross-sectional view of the prior art protective guard of FIG. 2.
FIG. 4 shows the prior art protective guard of FIGS. 2 and 3 secured atop the fence of FIG. 1.
FIG. 5 shows a perspective view of the prior art protective guard of FIGS. 2–4 secured atop the fence of FIG. 1.

FIG. 6 shows a protective guard 100 for a fence, in accordance with certain preferred embodiments of the present invention. The protective guard 100 includes an elongated tube 102 having a first end 104 and a second end 106 remote therefrom. The tube is preferably cylindrical in shape and defines an interior space 108 of the tube that extends between the first and second ends 104, 106 thereof. The protective guard also includes opposing attachment flanges 112A, 112B that are integrally formed with and extend from a lower end 110 of tube 102. The opposing attachment flanges 112A, 112B are preferably made of the same material that comprises the elongated tube 102.

FIG. 7 shows a cross-sectional view of the protective guard 100 of the present invention including elongated flexible tube 102 and integrally formed opposing attachment flanges 112A and 112B. The lower end 110 of tube 102 has an opening 114 formed therein so that the opposing attachment flanges 112A, 112B may be flexed away from one another for allowing an upper edge of a fence to be inserted into internal space 108 of tube 102.

Referring to FIG. 8, the opposing attachment flanges 112A, 112B include a series of aligned openings 116 extending along the length of the protective guard and through the attachment flanges so that a securing element 118, such as a screw 120 and a nut 122, may be used to secure the attachment flanges together.

Figure 9:
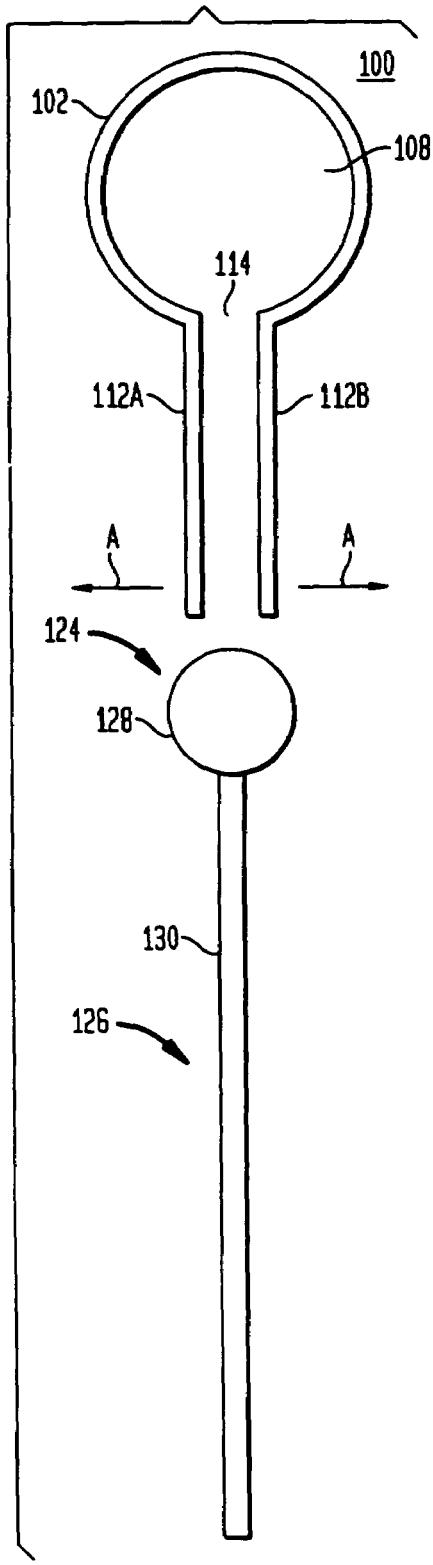
FIG. 9 shows the protective guard of FIGS. 6 and 7 being secured atop a fence.
Figure 10:
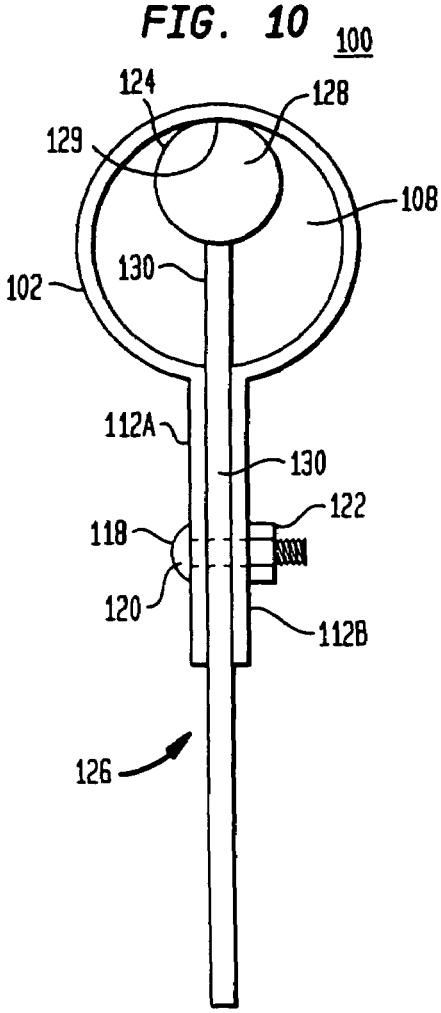
FIG. 10 shows the protective guard of FIGS. 6 and 7 after the protective guard has been secured atop a fence and held in place using a securing element.

FIGS. 9 and 10 show the protective guard 100 of the present invention being secured atop an upper edge 124 of a fence 126, the fence including top support rail 128 and wire mesh section 130. During installation of the protective guard 100 atop a fence, the lower ends of the attachment flanges 112A, 112B may be moved in opposite directions designated by arrows A—A. As a result, the top support rail 128 may pass between the attachment flanges 112A, 112B, through opening 114 and into interior space 108 of tube 102.

FIG. 10 shows the protective guard 100 of the present invention secured atop upper edge 124 of fence 126. After the protective guard has been assembled to the fence 126, the top support rail 128 preferably rests against an interior top surface 129 of tube 102 and a portion of wire mesh 130 lies within interior space 108 of tube 102. The securing element 118 is then passed through an opening in first attachment flange 112A, through wire mesh 130, and through an opening in second attachment flange 112B. A nut 122 is preferably threaded onto an end of screw 120 for clamping the wire mesh 130 between the opposing attachment flanges 112A, 112B. In other preferred embodiments, any type of securing element may be used for holding the opposing attachment flanges together, including clips, ties, bolts, clamps, etc.

Although the present invention is not limited by any particular theory of operation, it is believed that providing integrally formed attachment flanges 112A, 112B at a lower end of a flexible tube 102 enables the protective guard 100 to be reliably secured to an upper edge of a fence, such as a chain link fence. As a result, the protective guard will not be blown off, fall off, be jarred off, or stolen by vandals, thereby insuring that the protective guard will always be in place when needed to protect individuals who collide with the fence.

Figure 11:
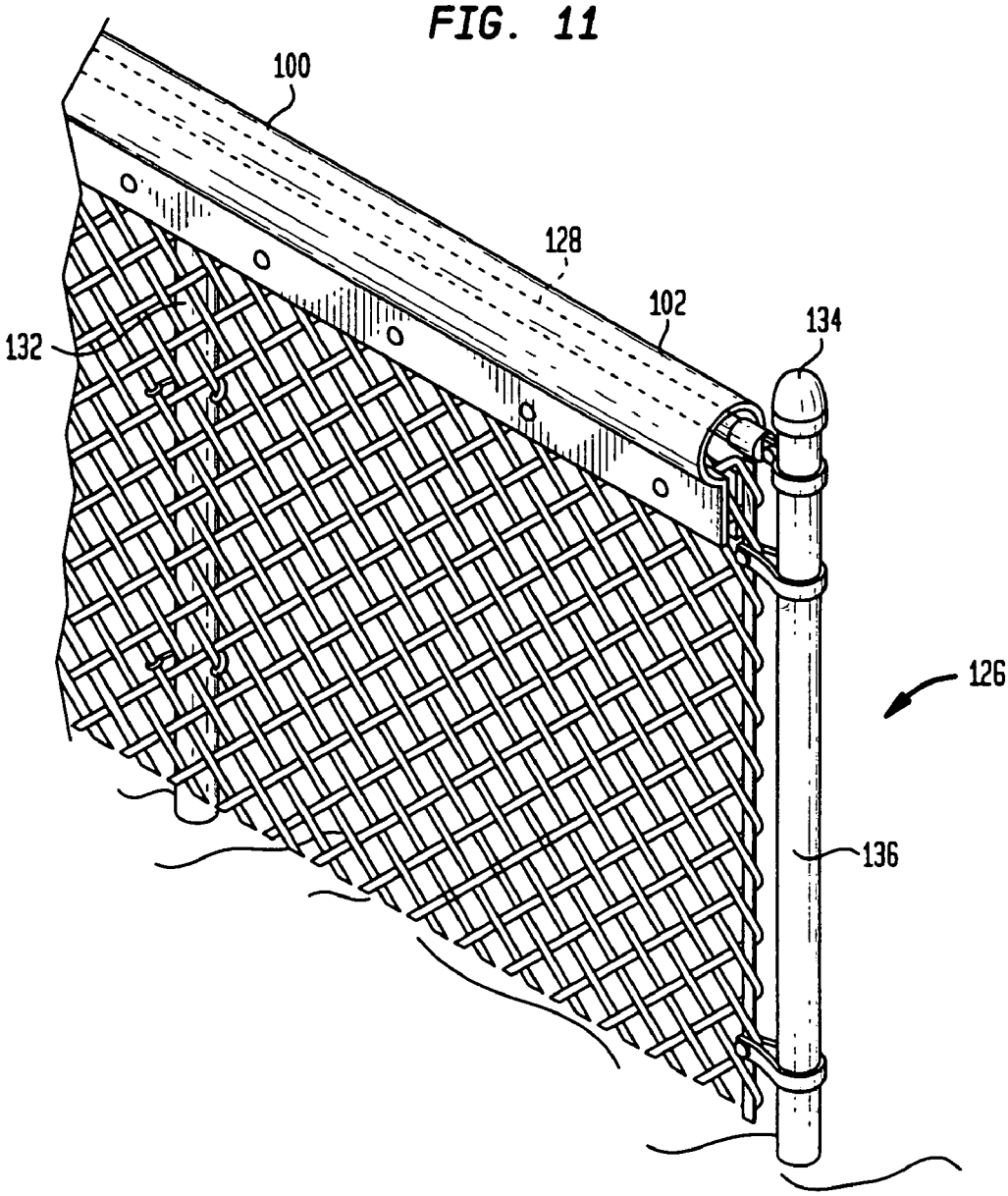
FIG. 11 shows a perspective view of a fence having the protective guard of FIGS. 6 and 7 secured atop the fence and held in place using securing elements, in accordance with certain preferred embodiments of the present invention.

FIG. 11 shows a perspective view of the protective guard 100 secured atop fence 126. The protective guard extends over top support bar 128 and an upper end of intermediate post 132. In certain preferred embodiments, the protective guard 100 may be modified to enlarge the tube portion 102 thereof so that the tube completely surrounds any component present at the upper edge of the fence, such as an enlarged cap atop an end post.

Figure 12:
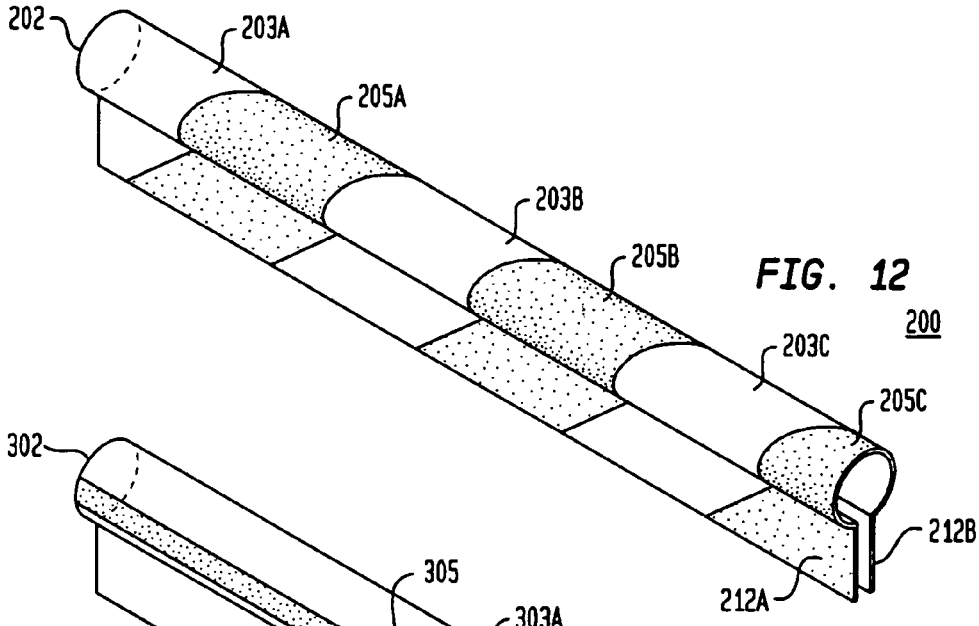
FIG. 12 shows a perspective view of a protective guard, in accordance with other preferred embodiments of the present invention.

FIG. 12 shows a protective guard, in accordance with other preferred embodiments of the present invention. The protective guard includes an elongated tube 202 and opposing first and second attachment flanges 212A and 212B. The protective guard 200 is preferably made of an extruded material, such as extruded plastic, whereby the colors of the plastic are alternated to give the protective guard a striped appearance. In the particular embodiment shown in FIG. 12, the elongated tube and first and second attachment flanges including alternating first sections 203A, 203B, 203C and second sections 205A, 205B, 205C that are made of different colors. As a result, the protective guard has a striped appearance.

Figure 13:
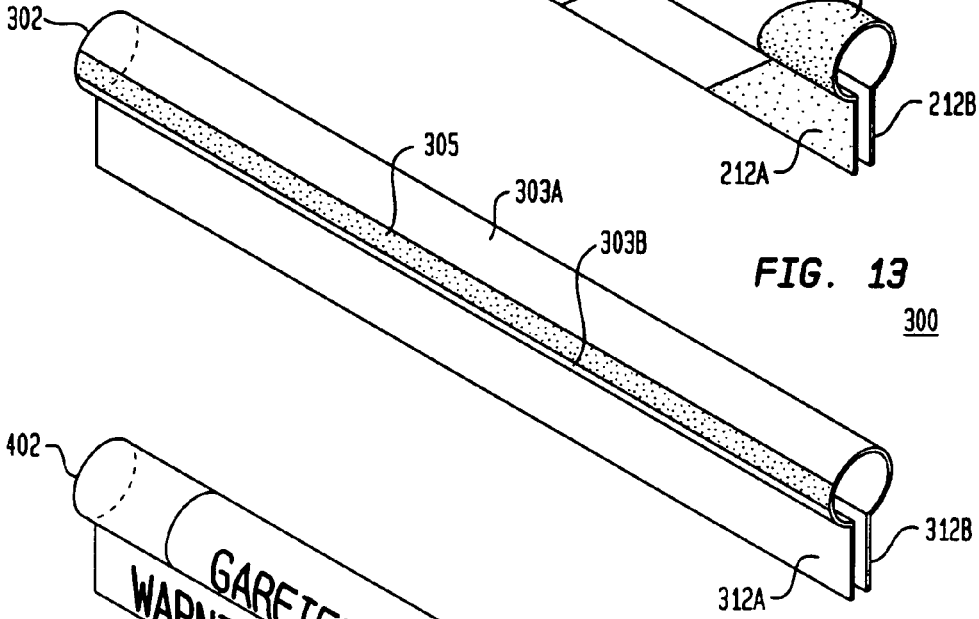
FIG. 13 shows a perspective view of a protective guard, in accordance with another preferred embodiment of the present invention.

FIG. 13 shows a protective guard 300 including an elongated tube 302 and opposing first and second attachment flanges 312A, 312B. The protective guard 300 has one or more stripes 305 that extend horizontally along the length of the protective guard. The horizontal stripe 305 is preferably of a color that is different than the alternating first sections 303A and 303B. As a result, the protective guard 300 has a striped appearance, whereby the stripes extend in a horizontal direction. The protective guard may also have a plurality of different colored stripes.

Figure 14:
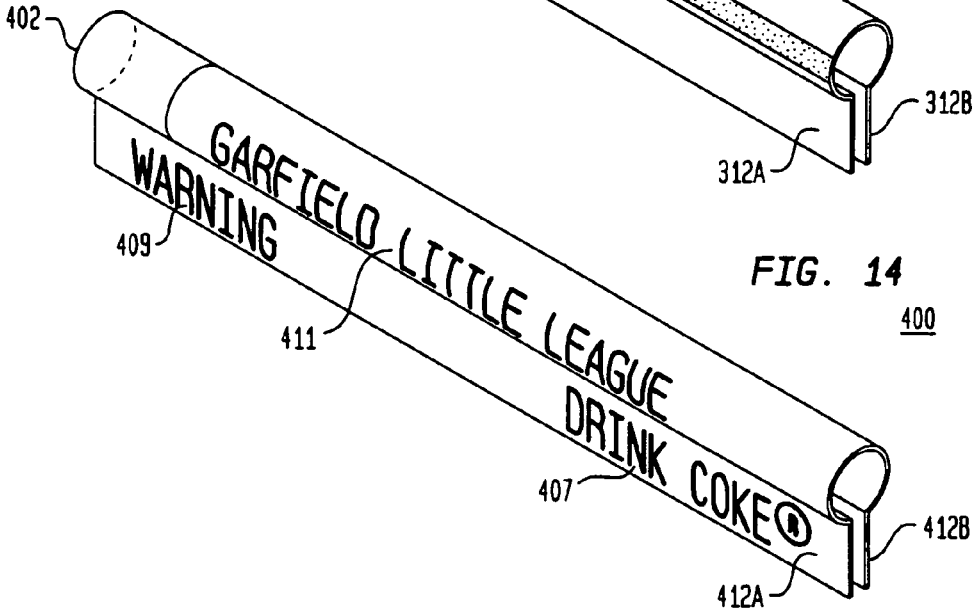
FIG. 14 shows a perspective view of a protective guard, in accordance with still another preferred embodiment of the present invention.

In the embodiment shown in FIG. 14, the protective guard 400 includes elongated tube 402 and opposing first and second attachment flanges 412A and 412B. The protective guard is extruded, and preferably comprises a polymer material. A message 405 may be screened anywhere on the protective guard 400. Preferred messages may include an advertisement 407, a warning 409, the name of a league 411, the name of a school, the name of a team, etc.

Figure 15:
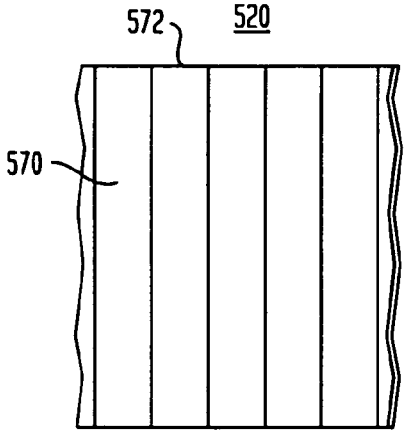
FIG. 15 shows a fence including wood slats.
Figure 16:
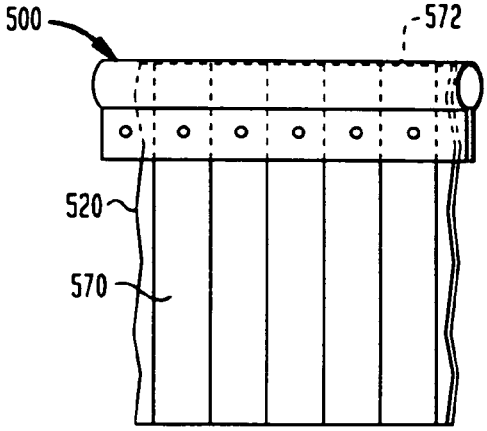
FIG. 16 shows the protective guard of FIG. 6 secured atop the fence of FIG. 15.

FIGS. 15 and 16 show the protective guard of the present invention secured atop a wood fence. Referring to FIG. 15, fence 520 is made of wooden slats 570 having upper ends 572. Referring to FIG. 16, the protective guard shown and described above in FIG. 6 is secured over the upper end 572 of one or more slats 570 for protecting the upper edge of fence 520.

Figure 17:
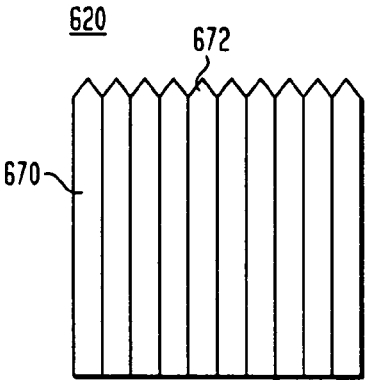
FIG. 17 shows a front elevational view of a fence.
Figure 18A:
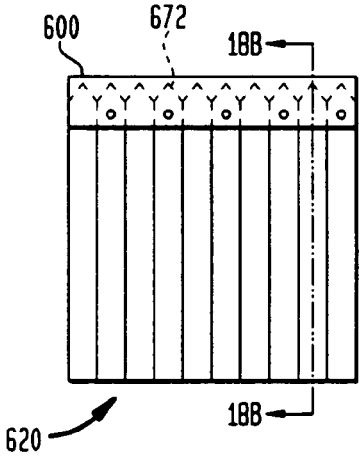
FIG. 18A shows the fence of FIG. 17 covered by a protective guard, in accordance with still another preferred embodiment of the present invention.
Figure 18B:
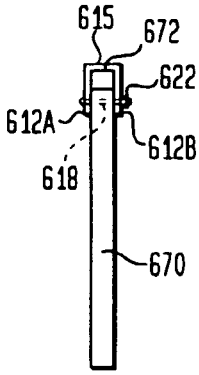
FIG. 18B shows the fence and protective guard of FIG. 18A taken along line 18B—18B of FIG. 18A.

FIG. 17 shows a fence 620 including slats 670 having upper ends 672 that are pointed. Referring to FIGS. 18A and 18B, a protective guard 600 is secured over the upper end 672 of the fence 620 so that the pointed end of the fence is covered by the protective guard 600. The protective guard has opposing attachment flanges 612A and 612B that extend on opposite sides of slat 670. A securing element 618 is passed through an opening in first attachment flange 612A, through slat 670 and through a second opening in second attachment flange 612B. A nut 622 is preferably threaded onto an end of securing element 618 for securing the slat between the opposing attachment flanges 612A, 612B. In other preferred embodiments, any kind of securing element may be used for holding the opposing attachment flanges 612A, 612B together, such as clips, ties, bolts, clamps, etc. Such securing element may pass over the top of the protective guard 600.

Referring to FIG. 18B, in certain preferred embodiments, the elongated tube at the top of the protective guard is not substantially cylindrical in shape, but is squared off to provide a snugger fit between the protective guard and the fence. In a particular preferred embodiment shown in FIG. 18B, the protective guard is an elongated member having a substantially flat top 615, whereby the opposing attachment flanges 612A, 612B extend downwardly from the substantially flat top 615. As a result, the opposing flanges extend in a direction substantially perpendicular to the plane of the substantially flat top. In other preferred embodiments, the top of the protective guard may be slightly curved to pass over the upper ends 672 of the slats 670.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A protective guard securable over a top support bar of a fence comprising:

an elongated tubular member having first and second ends, an outer surface, an inner surface defining an interior space for capturing said top support bar and an elongated opening extending between said inner and outer surfaces and said first and second ends, wherein said elongated tubular member is securable over said top support bar of said fence;

first and second attachment flanges integrally formed with said elongated tubular member on opposite sides of said elongated opening, wherein said first and second attachment flanges are adapted for engaging opposite sides of said fence when said protective guard is secured atop said top support bar of said fence;

said first and second attachment flanges having a series of first and second openings that are in substantial alignment with one another; and at least one securing element extending through one of said first openings and one of said second openings for securing said attachment flanges together.

2. The protective guard as claimed in claim 1, wherein said elongated tube is substantially cylindrical.

3. The protective guard as claimed in claim 1, wherein said first and second attachment flanges extend in planes that oppose one another.

4. The protective guard as claimed in claim 1, wherein said first and second attachment flanges extend in planes that are substantially parallel with one another.

5. The protective guard as claimed in claim 1, wherein said attachment flanges are adapted for flexing away from one another for securing said protective guard over top of said fence.

6. The protective guard as claimed in claim 1, wherein said at least one securing element includes a plurality of securing elements.

7. The protective guard as claimed in claim 6, wherein each said securing element is passable through one of said first openings in said first attachment flange and one of said second openings in said second attachment flange for securing said first and second attachment flanges together.

8. The protective guard as claimed in claim 1, wherein said elongated member and said first and second attachment flanges integrally formed with said elongated member are flexible.

9. The protective guard as claimed in claim 1, wherein said elongated member and said first and second attachment flanges are made of plastic.

10. The protective guard as claimed in claim 1, wherein said elongated member and said first and second attachment flanges are made of extruded plastic.

11. The protective guard as claimed in claim 1, wherein said protective guard has stripes of alternating colors between the first and second ends thereof.

12. The protective guard as claimed in claim 1, wherein said protective guard has substantially horizontal stripes of alternating color extending between the first and second ends thereof.

13. The protective guard as claimed in claim 1, further comprising a text message provided on the outer surface of said protective guard.

14. A combination including a protective guard securable over an upper edge of a fence comprising:

said fence including a top support bar;

said protective guard including an elongated, flexible tubular member having first and second ends, an outer surface, an inner surface defining an interior space and an elongated opening extending between said inner and outer surfaces and said first and second ends, wherein said elongated, flexible tubular member is securable over said top support bar of said fence;

first and second attachment flanges integrally formed with said elongated member on opposite sides of said elongated opening, wherein said first and second attachment flanges are adapted for engaging opposite sides of said fence when said protective guard is secured atop said top support bar of said fence; and at least one securing element engaging said first and second attachment flanges and passing through said fence for securing said protective guard to said fence.

15. The combination as claimed in claim 14, wherein said elongated tubular member has a substantially cylindrical shape.

16. The combination as claimed in claim 14, wherein said fence is a chain link fence having wire mesh and said securing element passes through the wire mesh of said chain link fence.

17. The combination as claimed in claim 14, wherein said first attachment flange includes a series of first openings and said second attachment flange includes a series of second openings in substantial alignment with said first openings.

18. The combination as claimed in claim 17, wherein said at least one securing element comprises a plurality of securing elements, each said securing element engaging one of said first openings of said first attachment flange and one of said second openings of said second attachment flange for securing said first and second attachment flanges on opposite sides of said fence.

* * * * *